US010435769B2

(12) United States Patent
Jaatinen

(10) Patent No.: US 10,435,769 B2
(45) Date of Patent: Oct. 8, 2019

(54) METHOD FOR REFINING SULFIDIC COPPER CONCENTRATE

(71) Applicant: OUTOTEC (FINLAND) OY, Espoo (FI)

(72) Inventor: Akusti Jaatinen, Espoo (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 16/247,900

(22) Filed: Jan. 15, 2019

(65) Prior Publication Data

US 2019/0144970 A1 May 16, 2019

Related U.S. Application Data

(63) Continuation of application No. PCT/FI2017/050543, filed on Jul. 20, 2017, which is a continuation of application No. PCT/FI2016/050537, filed on Jul. 22, 2016.

(51) Int. Cl.
*C22B 15/00* (2006.01)
*C22B 5/08* (2006.01)

(52) U.S. Cl.
CPC ..... *C22B 15/0054* (2013.01); *C22B 5/08* (2013.01); *C22B 15/0028* (2013.01); *C22B 15/0047* (2013.01); *C22B 15/0052* (2013.01)

(58) Field of Classification Search
CPC ..... C22B 15/0047; C22B 15/0054; C22B 15/0052; C22B 15/0039; C22B 15/006; C22B 7/04; C22B 4/04; C22B 5/02; C22B 5/08
See application file for complete search history.

(56) References Cited

U.S. PATENT DOCUMENTS 6,761,749 B1 * 7/2004 Poijarvi ..... C22B 15/0028 75/10.35
8,771,396 B2 7/2014 Zhou et al.
2013/0269481 A1 10/2013 Zhou et al.

FOREIGN PATENT DOCUMENTS

RU 2115753 * 9/1998
RU 2261929 * 10/2005
WO 2009077651 A1 6/2009
WO 2015158963 A1 10/2015

OTHER PUBLICATIONS

RU 2115753 machine translation of the description (Year: 1998).*
(Continued)

*Primary Examiner* — Tima M. McGuthry-Banks
(74) *Attorney, Agent, or Firm* — Robert P. Michal, Esq.; Carter, DeLuca & Farrell LLP

(57) ABSTRACT

A method for refining sulfidic copper concentrate includes feeding sulfidic copper concentrate and oxygen-bearing reaction gas and slag forming material into a reaction shaft of a suspension smelting furnace, collecting slag and blister copper in a settler of the suspension smelting furnace to form a blister layer containing blister copper and a slag layer, and discharging slag and blister copper separately from the settler of the suspension smelting furnace, so that slag is fed into an electric furnace. The method further includes feeding a part of the sulfidic copper concentrate into the electric furnace.

17 Claims, 3 Drawing Sheets

(56) References Cited

OTHER PUBLICATIONS

RU 2261929 machine translation of the description (Year: 2005).*
Written Opinion of the International Searching Authority issued by the European Patent Office acting as the International Searching Authority in relation to International Application No. PCT/FI2017/050543 dated Nov. 2, 2017 (5 pages).
International Search Report issued by the European Patent Office acting as the International Searching Authority in relation to International Application No. PCT/FI2017/050543 dated Nov. 2, 2017 (4 pages).

* cited by examiner

METHOD FOR REFINING SULFIDIC COPPER CONCENTRATE

CROSS-REFERENCE TO RELATED APPLICATIONS

This application is a continuation of PCT International Application No. PCT/FI2017/050543 filed Jul. 20, 2017, which claims priority to PCT International Application No. PCT/FI2016/050537, filed Jul. 22, 2016, the disclosure of each of these applications is expressly incorporated herein by reference in their entirety.

FIELD OF THE INVENTION

The invention relates to method for refining sulfidic copper concentrate.

Blister copper means in this context a molten impure copper product consisting mainly of metallic copper (>96%) intended for further refining in anode furnaces.

Matte copper means in this context an impure copper product consisting mainly of copper and iron sulfides.

Figure 1:
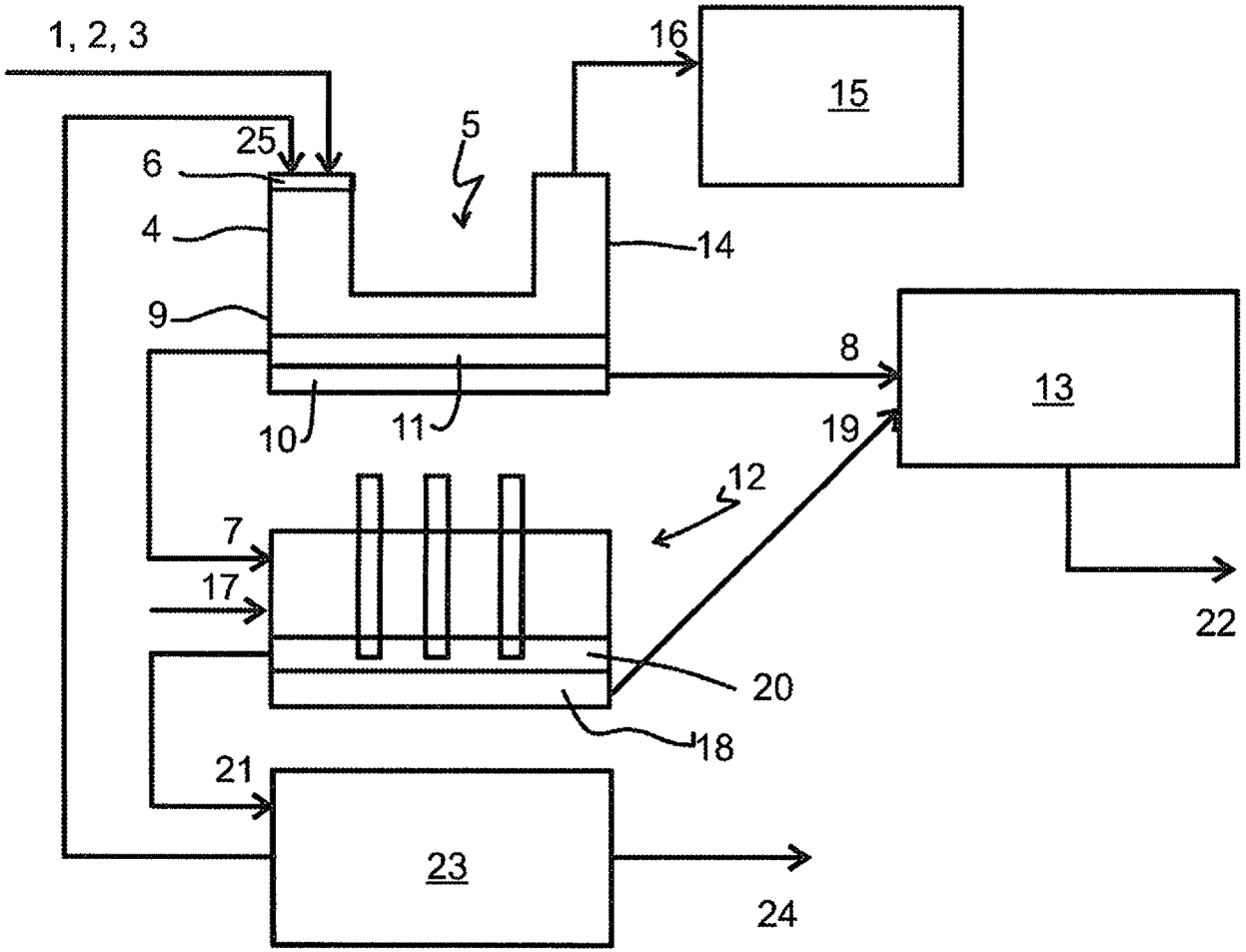
FIG 1 PRIOR ART

FIG. 1 shows block diagram of an embodiment of a direct to blister process for refining copper concentrate into anode copper.

In the direct to blister process sulfidic copper concentrate 1, oxygen-bearing reaction gas 2, and slag forming material 3, is fed into a reaction shaft 4 of a suspension smelting furnace 5 by means of a burner 6 that is arranged on top of the reaction shaft 4 of the suspension smelting furnace 5 so that sulfidic copper concentrate 1 and oxygen-bearing reaction gas 2 and slag forming material 3 react in the reaction shaft 4 of the suspension smelting furnace 5 into blister copper 8 and slag 7. Slag 7 and blister copper 8 are collected in a settler 9 of the suspension smelting furnace 5 to in the settler 9 of the suspension smelting furnace 5 form a blister layer 10 containing blister copper 8 and a slag layer 11 containing slag 7 on top of the blister layer 10.

Slag 7 and blister copper 8 are separately discharged from the settler 9 of the suspension smelting furnace 5, so that slag 7 is fed into an electric furnace 12 and so that blister copper 8, that can have a copper content of 98 wt-% is fed into anode furnaces 13. Process gases 16 produced in the reactions in the suspension smelting furnace 5 are discharged from the suspension smelting furnace 5 via an uptake 14 of the suspension smelting furnace 5 to a process gas treatment arrangement 15 that normally comprises a waste heat boiler (not shown in the figures) and an electric filter (not shown in the figures).

The slag 7 fed from the settler 9 of the suspension smelting furnace 5 into the electric furnace 12 is in the electric furnace 12 reduced by feeding additionally carbon containing reducing agent 17 such as coke into the electric furnace so that in the electric furnace 12 is formed an electric furnace blister layer 18 containing electric furnace blister copper 19 and an electric furnace slag layer 20 containing electric furnace slag 21 on top of the electric furnace blister layer 18.

Electric furnace slag 21 and electric furnace blister copper 19 are separately discharged from the electric furnace 12 so that electric furnace blister copper 19, that can have a copper content of 97 wt-%, is fed into the anode furnaces 13 where anode copper 22 is produced and so that electric furnace slag 21, that can have a copper content of 4 wt-%, is subjected to final slag cleaning process 23. From the final slag cleaning process 23, that can performed for example by flotation in a flotation arrangement (not shown in the figures) or in an additional electric furnace (not shown in the figures) can slag concentrate or other copper containing product 25 be fed into the reaction shaft 4 of the suspension smelting furnace 5 and reject 24 such as tailings be discarded.

A problem with the direct-to-blister process when treating concentrates with low copper grade is that it produces a lot of thermal energy, which means that the process gas treatment arrangement for treating process gases produced in the process in the suspension smelting furnace has to have a large capacity.

Another problem is that the blister copper that is fed into the anode furnace has normally a different composition such as a different copper content on weight percentage basis than the electric furnace blister copper that is fed from the electric furnace into the anode furnace. Content of many impurities (such as arsenic) in the electric furnace blister copper can be high, causing challenges in maintaining high quality of the anode copper product.

Recovery of copper from the electric furnace slag by using flotation is also challenging because the copper contained in slag is mostly not in sulfidic form.

Publication U.S. Pat. No. 8,771,396 presents a method for producing blister copper directly from copper concentrate, characterized in that it comprises the following steps: a) feeding copper concentrate, copper matte, slagging material, oxygen enriched air, and endothermic material together into a reaction furnace at an upper segment of the reaction furnace; b) feeding reducing agent into the reaction furnace at the lower segment of the reaction furnace, wherein furnace gas, a hot coke layer in solid state, a slag layer in liquid state, and a blister copper layer in liquid state are formed in a molten bath at the bottom of the reaction furnace; c) directing the hot coke and the slag in liquid state into an electric furnace while feeding sulfidizing agent into the electric furnace, so as to produce an electric furnace slag and copper matte in the electric furnace; d) granulating the copper matte and re-feeding it into the reaction furnace at the upper segment of the reaction furnace, wherein the sulfidizing agent in step c) is sulfide copper concentrate with a moisture content of 4% by weight to 10% by weight, the mass ratio of said sulfide copper concentrate to said slag in liquid state is 4~6:1. A problem with this method is that because reducing agent in the form of coke is fed into the reaction furnace and because hot coke and slag in liquid state is fed into the electric furnace, modifications or special arrangements may be needed to the reaction furnace. The reason for this is that coke floats on the surface of the slag layer and it is therefore not easy to lead coke together with slag in liquid state from the reaction furnace to the electric furnace.

OBJECTIVE OF THE INVENTION

An object of the invention is to provide a method for refining sulfidic copper concentrate that solves the above mentioned problems.

SHORT DESCRIPTION OF THE INVENTION

The invention is based on using sulfidic copper concentrate as reducing agent in the electric furnace to reduce the slag that is fed in unreduced state from the suspension smelting furnace into the electric furnace by feeding a part of the sulfidic copper concentrate that is to be refined into the electric furnace instead of into the suspension smelting furnace. The sulfidic concentrate reacts with the oxygen contained in the Direct to Blister Furnace slag, resulting in immiscible copper matte and slag products. As oxygen from the slag is consumed in the reaction, copper contained in the slag is reduced. The copper matte formed in the process is solidified, treated and fed to the Direct to Blister Furnace as a feed material. This reduces the amount of process gases produced in the suspension smelting furnace, because a smaller amount of sulfidic copper concentrate is treated in the suspension smelting furnace, and because smelting the solid matte product requires high oxygen enrichment of the process gas.

Because blister copper is fed into the anode furnaces solely from the suspension smelting furnace, the composition of the blister copper that is treated in the anode furnace has a uniform composition and quality. Content of certain impurities, such as arsenic, in blister copper is lower because (i) in electric furnace, where impurities would enter the blister copper due to reducing conditions, they do so to lower extent because their chemical activity coefficient is higher in matte than in blister copper, (ii) all the blister fed to the anode furnaces is discharged from the direct to blister furnace, where the blister copper is in contact with a large amount of highly oxidized slag that dissolves the impurities.

If flotation is utilized in the final slag cleaning process for recovering copper from electric furnace slag, copper recovery is better than in Direct to Blister process because the copper contained in slag is mostly in sulfidic form, which means that copper containing particles are more easily flotated.

An advantage of discharging slag in unreduced form from the suspension smelting furnace into the electric furnace and not feed reducing agent into the suspension smelting furnace, as in the method of publication U.S. Pat. No. 8,771,396, is that in the method impurities such as arsenic, lead, bismuth and antimony will be discharged from the suspension smelting furnace as components of the slag and impurities will not migrate due to reducing reaction from the slag layer into the blister layer in the suspension smelting furnace, as can be the case in the method of publication U.S. Pat. No. 8,771,396. In this method, the blister copper layer will therefore contain less impurities than the blister copper layer that is formed in a method of publication U.S. Pat. No. 8,771,396.

An advantage of discharging slag in unreduced form from the suspension smelting furnace into the electric furnace and not feed reducing agent into the suspension smelting furnace, as in the method of publication U.S. Pat. No. 8,771,396, is that in the method the slag, that is fed in unreduced form from the suspension smelting furnace, will more efficiently react with the sulfidic copper concentrate in the electric furnace than in the method of publication U.S. Pat. No. 8,771,396. More precisely, the sulfur in the sulfidic copper concentrate will react with the oxygen in the slag. Because the slag will efficiently react with the sulfidic copper concentrate in the electric furnace in the method, this reduces the need for using other reducing agents such as coke in the electric furnace. The energy released in the exothermal reaction between sulfur in the sulfidic copper concentrate and oxygen in the slag also reduces the requirement for electric power in the electric furnace.

In an embodiment of the method, 5 to 50% of the sulfidic copper concentrate of the total amount of sulfidic copper concentrate, that is fed into the suspension smelting furnace and the electric furnace, is fed into the electric furnace. In this embodiment, the mass ratio of sulfidic copper concentrate that is fed into the electric furnace to slag that is fed into the electric furnace is preferably smaller than 1 to 1, more preferably between 0.25 to 1 and 0.7 to 1, even more preferably between 0.45 to 1 and 0.5 to 1. An advantage with this embodiment in comparison with the method of publication U.S. Pat. No. 8,771,396, where the mass ratio of said sulfide copper concentrate to said slag in liquid state is 4~6:1, is that this embodiment of the method requires less electrical energy, because the mayor part of the sulfide copper concentrate is melted in the suspension smelting furnace through an exothermic reaction with reaction gas instead of melting a major part of the sulfide copper concentrate in the electric furnace by using electric energy as is the case in the method of publication U.S. Pat. No. 8,771,396.

In an embodiment of the method the moisture content of the sulfidic copper concentrate that is fed into the electric furnace is below 1%, preferably below 0.5% by weight. An advantage with this embodiment of the method in comparison with the method of publication U.S. Pat. No. 8,771,396, where the moisture content of the sulfide copper concentrate is 4 to 10% by weight is that in this embodiment of the method a smaller amount of water vapor gases is formed in the electric furnace and the electric power requirement for vaporizing water is smaller.

LIST OF FIGURES

Figure 2:
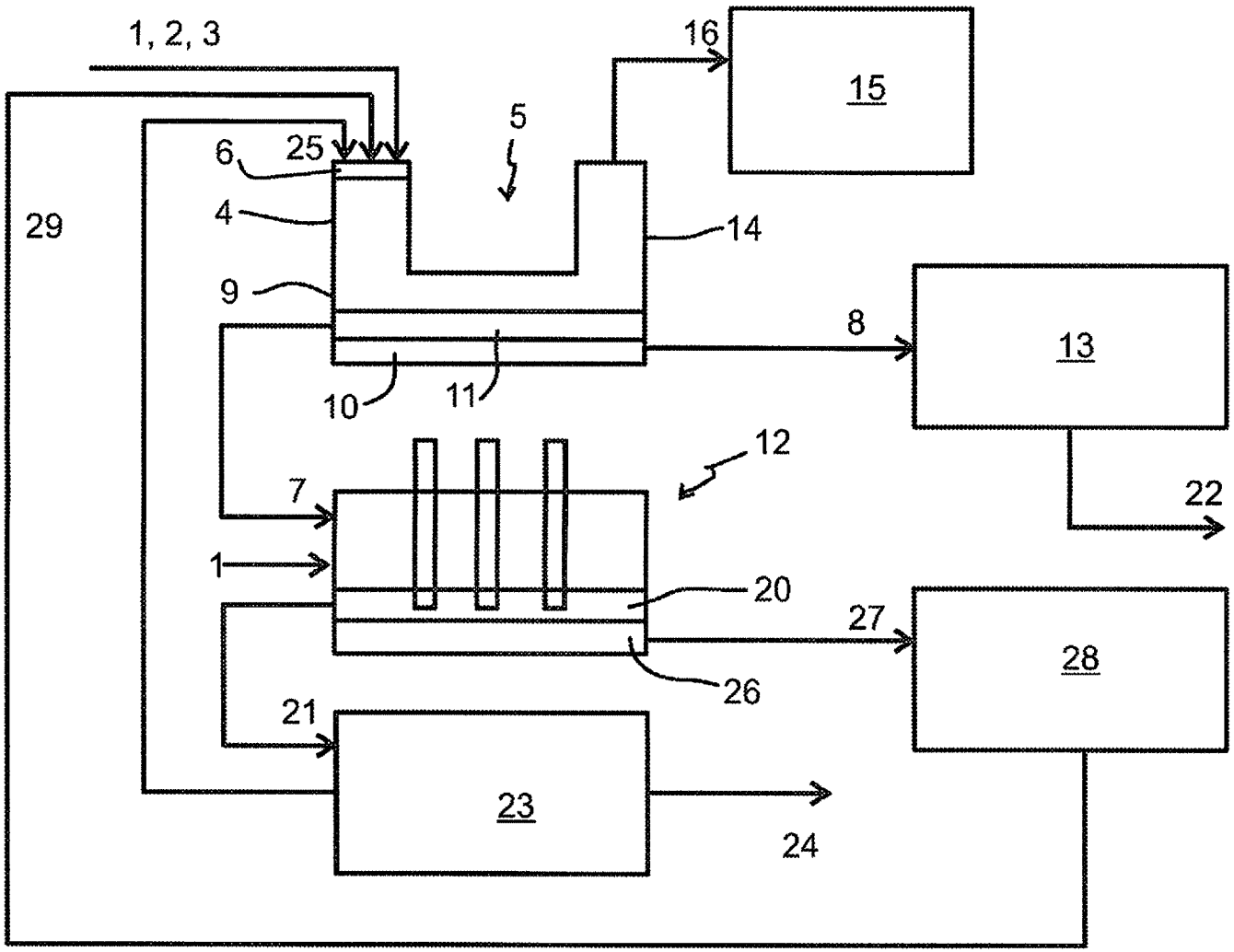
Figure 3:
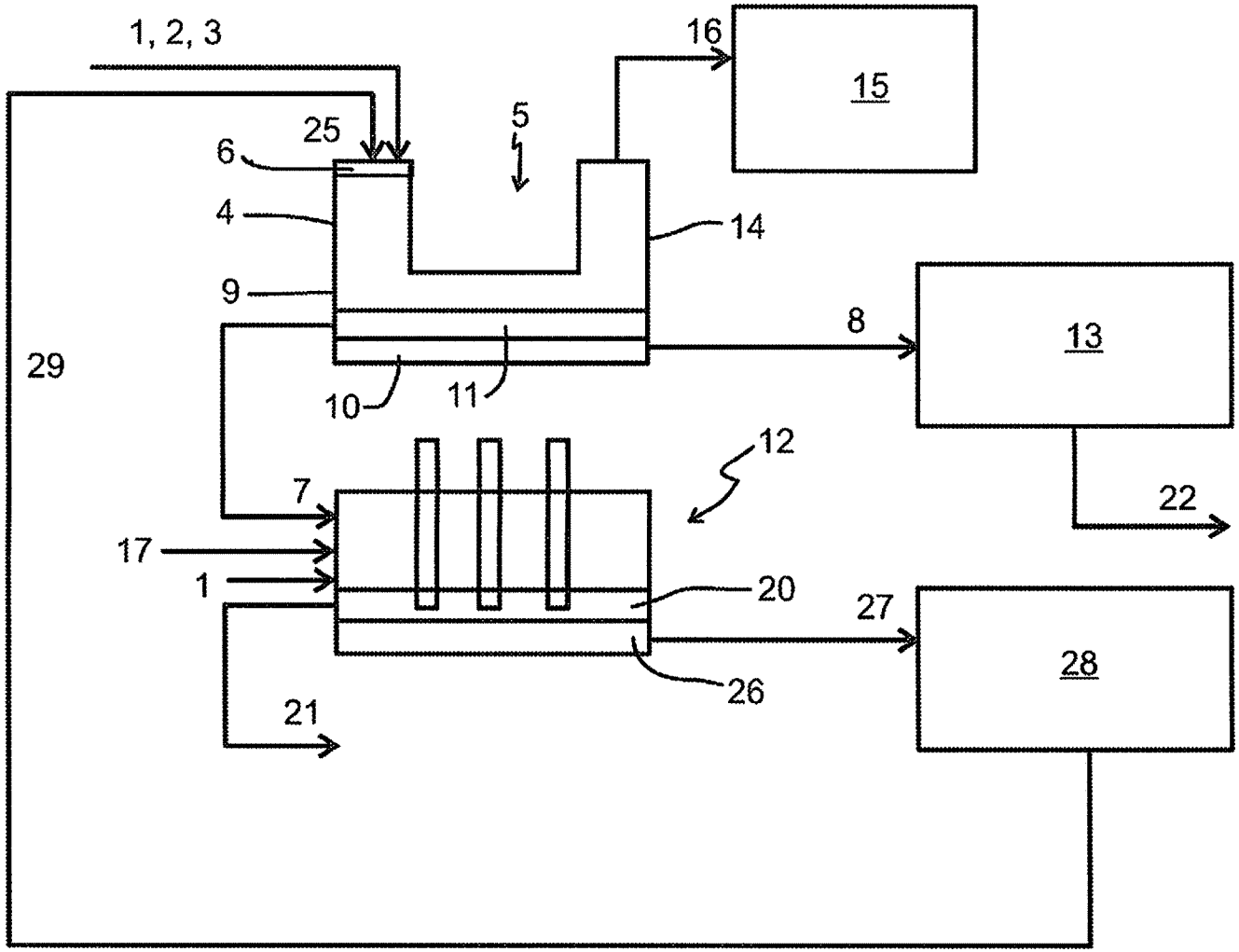

In the following the invention will described in more detail by referring to the figures, which FIG. 1 shows a block diagram of a direct to blister process, FIG. 2 shows a block diagram of a first embodiment of the method, and FIG. 3 shows a block diagram of a second embodiment of the method.

DETAILED DESCRIPTION OF THE INVENTION

FIG. 2 shows a block diagram of a first embodiment of the method for refining sulfidic copper concentrate 1 and FIG. 3 shows a block diagram of a second embodiment of the method for refining sulfidic copper concentrate 1.

The method comprises feeding sulfidic copper concentrate 1 and oxygen-bearing reaction gas 2 and slag forming material 3 into a reaction shaft 4 of a suspension smelting furnace 5 by means of a burner 6 that is arranged on top of the reaction shaft 4 of the suspension smelting furnace 5, whereby sulfidic copper concentrate 1 and oxygen-bearing reaction gas 2 and slag forming material 3 react in the reaction shaft 4 of the suspension smelting furnace 5 into blister copper 8 and slag 7.

The method comprises collecting slag 7 and blister copper 8 in a settler 9 of the suspension smelting furnace 5 to in the settler 9 of the suspension smelting furnace 5 form a blister layer 10 containing blister copper 8 and a slag layer 11 containing slag 7 on top of the blister layer 10.

The method comprises discharging slag 7 in unreduced state and blister copper 8 separately from the settler 9 of the suspension smelting furnace 5, so that slag 7 in unreduced state is fed into an electric furnace 12.

The method comprises feeding a part of the sulfidic copper concentrate 1 into the electric furnace 12.

The method comprises reducing the slag 7, that is fed in unreduced state from the suspension smelting furnace 5, in the electric furnace 12 at least partly with the sulfidic copper concentrate 1 that is fed into the electric furnace 12 to in the electric furnace 12 form a matte layer 26 containing copper matte 27 and an electric furnace slag layer 20 containing electric furnace slag 21 on top of the matte layer 26.

The method comprises discharging electric furnace slag 21 and matte copper separately from the electric furnace 12.

The method comprises granulating and treating 28 the copper matte 27 that is discharged from the electric furnace 12 to obtain copper matte feed material 29.

The method comprises feeding at least a part of said copper matte feed material 29 into the reaction shaft 4 of the suspension smelting furnace 5 by means of the burner 6.

The method may include, as shown in FIGS. 2 and 3, feeding blister copper 8 from the settler 9 of the suspension smelting furnace 5 into an anode furnace 13 or into anode furnaces 13, and fire refining blister in the anode furnace(s) 13.

The method may include, as shown in FIG. 2, subjecting the subjecting the electric furnace slag 21 to a final slag cleaning process 23 that can performed for example by flotation in a flotation arrangement (not shown in the figures) or in an additional electric furnace (not shown in the figures). From the final slag cleaning process 23 can slag concentrate or other copper containing product 25 be fed into the reaction shaft 4 of the suspension smelting furnace 5 by means of the burner 6 of the suspension smelting furnace 5 and reject 24 such as tailings be discarded.

The method may include, as shown in FIG. 3, feeding additionally carbon containing reducing agent 17 such as coke into the electric furnace 12.

The method may include, as shown in FIGS. 2 and 3, feeding process gases 16 from an uptake 14 of the suspension smelting furnace 5 to a process gas treatment arrangement 15.

The method may include feeding process gases from the electric furnace 12 to a process gas treatment arrangement 15.

The method may include feeding between 5 and 50%, preferably between 10 and 40%, more preferably between 25 and 35%, such as about 33%, of the sulfidic copper concentrate 1 into the electric furnace 12.

The mass ratio of sulfidic copper concentrate 1 that is fed into the electric furnace 12 to slag 7 that is fed into the electric furnace 12 is preferably smaller than 1 to 1, more preferably between 0.25 to 1 and 0.7 to 1, even more preferably between 0.45 to 1 and 0.5 to 1.

The moisture content of the sulfidic copper concentrate 1 that is fed into the electric furnace 12 is preferably below 1%, more preferably below 0.5% by weight.

The moisture content of the sulfidic copper concentrate 1 that is fed into the reaction shaft 4 of the suspension smelting furnace 5 is preferably below 1%, more preferably below 0.5% by weight.

Example 1

70% of the sulfidic copper concentrate (containing in percentages mass 25% Cu) was fed into the suspension smelting furnace at a feeding rate of 76 t/h and 30% of the sulfidic copper concentrate (containing in percentages mass 25% Cu) was fed into the electric furnace at a feeding rate of 33 t/h. From the suspension smelting furnace was discharged blister copper (containing in percentages mass 98.4% Cu) at a discharge rate of 26 t/h and slag containing in percentages mass 24% Cu at a rate of 73 t/h into the electric furnace. From the electric furnace was discharged copper matte (containing in percentages mass 65% Cu) at a rate of 37 t/h and electric furnace slag (containing in percentages mass 2% Cu) at a rate of 65 t/h into a slag cleaning process including slag flotation. The copper matte discharged from the electric furnace was granulated, grinded and fed into the suspension smelting furnace. From the slag cleaning process was slag concentrate (containing in percentages mass 20% Cu) recycled into the suspension smelting furnace at a feed rate of 5 t/h and tailings (containing in percentages mass 0.5% Cu) was discharged.

Example 2

65% of the sulfidic copper concentrate (containing in percentages mass 25% Cu) was fed into the suspension smelting furnace at a feeding rate of 70 t/h and 35% of the sulfidic copper concentrate (containing in percentages mass 25% Cu) was fed into the electric furnace at a feeding rate of 42 t/h. From the suspension smelting furnace was discharged blister copper (containing in percentages mass 98.4% Cu) at a discharge rate of 26 t/h and slag containing in percentages mass 24% Cu at a rate of 83 t/h into the electric furnace. Reducing agent in the form of Coke was also fed into the electric furnace at a feeding rate of 2 t/h. From the electric furnace was discharged copper matte (containing in percentages mass 55% Cu) at a rate of 51 t/h and electric furnace slag (containing in percentages mass <1% Cu) at a rate of 70 t/h. The copper matte discharged from the electric furnace was granulated, grinded and fed into the suspension smelting furnace.

It is apparent to a person skilled in the art that as technology advances, the basic idea of the invention can be implemented in various ways. The invention and its embodiments are therefore not restricted to the above examples, but they may vary within the scope of the claims.

The invention claimed is:

1. A method for refining sulfidic copper concentrate, the method comprising:

feeding a first portion of sulfidic copper concentrate and oxygen-bearing reaction gas and slag forming material into a reaction shaft of a suspension smelting furnace by means of a burner that is arranged on top of the reaction shaft of the suspension smelting furnace, whereby sulfidic copper concentrate and oxygen-bearing reaction gas and slag forming material react in the reaction shaft of the suspension smelting furnace into blister copper and slag;

collecting slag and blister copper in a settler of the suspension smelting furnace to form a blister layer containing blister copper and a slag layer containing slag on top of the blister layer;

discharging slag in an unreduced state and blister copper separately from the settler of the suspension smelting furnace, so that slag in an unreduced state is fed into an electric furnace;

feeding a second portion of sulfidic copper concentrate into the electric furnace;

reducing the slag that is fed in the unreduced state from the suspension smelting furnace in the electric furnace at least partly with the second portion of sulfidic copper concentrate that is fed into the electric furnace to form a matte layer containing copper matte and an electric furnace slag layer containing electric furnace slag on top of the matte layer;

discharging electric furnace slag and matte copper separately from the electric furnace;

granulating and treating the copper matte that is discharged from the electric furnace to obtain copper matte feed material; and feeding at least a part of the copper matte feed material into the reaction shaft of the suspension smelting furnace by means of the burner.

2. The method according to claim 1, further comprising:

feeding blister copper from the settler of the suspension smelting furnace into an anode furnace;

fire refining the blister copper in the anode furnace.

3. The method according to claim 1, further comprising:

subjecting the electric furnace slag to a final slag treatment process to form reject and slag concentrate or other copper containing product; and feeding the slag concentrate or other copper containing product by means of the burner into the reaction shaft of the suspension smelting furnace.

4. The method according to claim 1, further comprising:

feeding a carbon containing reducing agent into the electric furnace, wherein the carbon containing reducing agent is coke.

5. The method according to claim 1, further comprising:

feeding process gases from an uptake of the suspension smelting furnace to a process gas treatment arrangement.

6. The method according to claim 1, further comprising:

feeding process gases from the electric furnace to a process gas treatment arrangement.

7. The method according to claim 1, wherein the second portion of sulfidic copper concentrate that is fed into the electric furnace includes between 5 and 50% of the total amount of sulfidic copper concentrate, the total amount of sulfidic copper concentrate comprising the first and second portions of sulfidic copper concentrate.

8. The method according to claim 1, wherein the second portion of sulfidic copper concentrate that is fed into the electric furnace includes between 10 and 40% of the total amount of sulfidic copper concentrate, the total amount of sulfidic copper concentrate comprising the first and second portions of sulfidic copper concentrate.

9. The method according to claim 1, wherein the second portion of sulfidic copper concentrate that is fed into the electric furnace includes between 25 and 35% of the total amount of sulfidic copper concentrate, the total amount of sulfidic copper concentrate comprising the first and second portions of sulfidic copper concentrate.

10. The method according to claim 1, wherein the mass ratio of the second portion of the sulfidic copper concentrate that is fed into the electric furnace to slag that is fed into the electric furnace is smaller than 1 to 1.

11. The method according to claim 10, wherein the mass ratio of the second portion of the sulfidic copper concentrate that is fed into the electric furnace to slag that is fed into the electric furnace is between 0.25 to 1 and 0.7 to 1.

12. The method according to claim 10, wherein the mass ratio of the second portion of the sulfidic copper concentrate that is fed into the electric furnace to slag that is fed into the electric furnace is between 0.25 to 1 and 0.7 to 1.

13. The method according to claim 1, wherein the moisture content of the second portion of the sulfidic copper concentrate that is fed into the electric furnace is below 1% by weight.

14. The method according to claim 1, wherein the moisture content of the second portion of the sulfidic copper concentrate that is fed into the electric furnace is below 0.5% by weight.

15. The method according to claim 1, wherein the moisture content of the first portion of the sulfidic copper concentrate that is fed into the reaction shaft of the suspension smelting furnace is below 1% by weight.

16. The method according to claim 1, wherein the moisture content of the first portion of the sulfidic copper concentrate that is fed into the reaction shaft of the suspension smelting furnace is below 0.5% by weight.

17. The method according to claim 1, wherein the second portion of the sulfidic copper concentrate that is fed into the electric furnace includes about 33% of the total amount of sulfidic copper concentrate, the total amount of sulfidic copper concentrate comprising the first and second portions of sulfidic copper concentrate.

* * * * *